US007931032B1

(12) United States Patent
Penkauskas et al.

(10) Patent No.: US 7,931,032 B1
(45) Date of Patent: Apr. 26, 2011

(54) BULK DISPENSING OF CHEMICALS INTO A RESIDENTIAL DISHWASHER

(75) Inventors: Daniel J. Penkauskas, Mission Viejo, CA (US); George J. Noa, Jr., Foothill Ranch, CA (US)

(73) Assignee: Knight, LLC, Lake Forest, CA (US)

( * ) Notice: Subject to any disclaimer, the term of this patent is extended or adjusted under 35 U.S.C. 154(b) by 0 days.

(21) Appl. No.: 12/619,984

(22) Filed: Nov. 17, 2009

Related U.S. Application Data

(62) Division of application No. 11/437,427, filed on May 19, 2006.

(51) Int. Cl.
*B08B 3/02* (2006.01)

(52) U.S. Cl. ..... 134/94.1; 134/99.2

(58) Field of Classification Search ..... 134/57 D, 134/56 D, 58 D, 99.2
See application file for complete search history.

(56) References Cited

U.S. PATENT DOCUMENTS

| | | | | |
|---|---|---|---|---|
| 2,974,832 | A | 11/1956 | Brucken | |
| 2,959,341 | A | 11/1960 | Noakes | |
| 3,144,031 | A | 8/1964 | Long | |
| 3,212,675 | A | 10/1965 | Thomas | |
| 3,399,813 | A | 9/1968 | Theyssen | |
| 3,729,013 | A | 4/1973 | Anderson | |
| 3,739,942 | A | 6/1973 | Mercer et al. | |
| 3,827,600 | A * | 8/1974 | Janke | 222/651 |
| 3,876,117 | A | 4/1975 | Wright et al. | |
| 4,190,181 | A | 2/1980 | Arnaud | |
| 4,974,750 | A | 12/1990 | Welch | |
| 4,989,761 | A | 2/1991 | Ikeda | |
| 5,133,487 | A | 7/1992 | Russi | |
| 5,176,297 | A | 1/1993 | Mooney et al. | |
| 5,259,682 | A * | 11/1993 | Uchiyama | 401/185 |
| 5,413,259 | A | 5/1995 | Cerruti et al. | |
| 5,603,431 | A | 2/1997 | Tuller | |
| 5,694,794 | A | 12/1997 | Jerg et al. | |
| 5,772,785 | A | 6/1998 | Schouten | |
| 5,839,454 | A | 11/1998 | Matz | |
| 6,138,693 | A | 10/2000 | Matz | |
| 6,189,551 | B1 | 2/2001 | Sargeant et al. | |
| 6,564,968 | B1 * | 5/2003 | Terrell et al. | 222/63 |
| 6,819,977 | B2 | 11/2004 | Howes et al. | |
| 6,834,779 | B2 | 12/2004 | Ufheil et al. | |
| 6,923,191 | B2 | 8/2005 | Cerruti et al. | |

(Continued)

FOREIGN PATENT DOCUMENTS

| | | | |
|---|---|---|---|
| DE | 3442194 | A1 | 5/1986 |

(Continued)

*Primary Examiner* — Frankie L Stinson
(74) *Attorney, Agent, or Firm* — Stout, Uxa Buyan & Mullins, LLP; Donald E. Stout

(57) ABSTRACT

A fluid dispensing system for a residential dishwasher comprises a fluid reservoir that can hold liquid gel dish detergent in bulk quantities, preferably comprising the contents of at least one bottle of detergent as sold at retail, which is disposed inside a door of the dishwasher. The reservoir is filled with detergent from the inside of the door, to facilitate clean-up if any product is accidentally spilled. As a result, the dishwasher is made easier and more convenient to use, by reducing the repetitive step of loading detergent and allowing "peace of mind" delegation of the dishwashing task. Metered doses of the fluid may be dispensed. In addition to dish detergent, liquid rinse aids may also be dispensed using the disclosed system.

6 Claims, 8 Drawing Sheets

U.S. PATENT DOCUMENTS

| | | | | |
|---|---|---|---|---|
| 6,969,163 | B2 | 11/2005 | Studer et al. | |
| 7,047,987 | B2 | 5/2006 | Cerruti et al. | |
| 7,198,175 | B2 * | 4/2007 | Ophardt | 222/188 |
| 7,275,552 | B2 | 10/2007 | DeWeerd et al. | |
| 7,284,561 | B2 | 10/2007 | Byrne et al. | |
| 7,464,718 | B2 | 12/2008 | McIntyre et al. | |
| 7,571,734 | B2 * | 8/2009 | Kappler et al. | 134/58 D |
| 2002/0088502 | A1 | 7/2002 | Van Rompuy et al. | |
| 2003/0168085 | A1 | 9/2003 | Sowle et al. | |
| 2004/0231710 | A1 | 11/2004 | Dingler et al. | |
| 2005/0000551 | A1 | 1/2005 | McIntyre et al. | |
| 2005/0045652 | A1 | 3/2005 | Maser | |
| 2005/0121058 | A1 | 6/2005 | Furber et al. | |
| 2005/0126607 | A1 | 6/2005 | Haft et al. | |
| 2006/0059958 | A1 | 3/2006 | Byrne et al. | |
| 2006/0117811 | A1 * | 6/2006 | Kinnetz | 68/17 R |
| 2006/0151544 | A1 * | 7/2006 | Greenwald et al. | 222/333 |
| 2007/0295755 | A1 | 12/2007 | Kinzie et al. | |

FOREIGN PATENT DOCUMENTS

| | | | | |
|---|---|---|---|---|
| DE | 3701404 | A1 | | 8/1987 |
| DE | 3812109 | A1 | | 10/1989 |
| DE | 3831745 | A1 | | 3/1990 |
| DE | 3833961 | A1 | | 4/1990 |
| DE | 4000378 | A1 | | 7/1991 |
| DE | 19643270 | A1 | | 4/1998 |
| EP | 0 423 044 | | * | 4/1991 |
| EP | 0423044 | A1 | | 4/1991 |
| EP | 0430366 | A1 | | 6/1991 |
| EP | 0499785 | A1 | | 8/1992 |
| EP | 0 691 101 | | * | 1/1996 |
| EP | 1226431 | A2 | | 4/2002 |

* cited by examiner

BULK DISPENSING OF CHEMICALS INTO A RESIDENTIAL DISHWASHER

This application is a divisional application under 35 U.S.C. 120 of commonly assigned U.S. patent application Ser. No. 11/437,427, entitled Bulk Dispensing of Chemicals into a Residential Dishwasher, filed on May 19, 2006, presently pending, which in turn claims the benefit under 35 U.S.C. 119(e) of the filing date of Provisional U.S. Application Ser. No. 60/683,188, entitled Bulk Dispensing of Chemicals Into a Residential Dishwasher, and filed on May 20, 2005. Each of the above referenced which applications are herein expressly incorporated by reference, in their entirety.

FIELD OF THE INVENTION

This invention relates generally to chemical dispensing systems, and more particularly, to systems for bulk dispensing of chemicals, such as detergents, into a residential dishwasher.

BACKGROUND OF THE INVENTION

Typically, residential dishwashing machines include built-in single-dose detergent dispensers. A single-dose dispenser must be re-filled every time the dishwashing machine is to be used, which requires an extra step. Additionally, manual filling of the dispenser cup often leads to accidental overfilling or underfilling.

What is needed, therefore, is a bulk detergent dispenser that does not need to be refilled every time that it is used, and can automatically dispense the correct amount of detergent, at the right time or times during the machine's operating cycle.

SUMMARY OF THE INVENTION

The inventive dispensing system comprises a detergent reservoir that can hold liquid gel dish detergent in bulk quantities, preferably comprising the contents of at least one bottle of detergent as sold at retail, which is disposed inside the dishwasher. The reservoir is filled with detergent from the inside of the door, to facilitate clean-up if any product is accidentally spilled. As a result, the dishwasher is made easier and more convenient to use, by reducing the repetitive step of loading detergent and allowing "peace of mind" delegation of the dishwashing task.

Metered dosage control is an added benefit of the present invention.

More particularly, in one aspect of the invention, there is provided a fluid dispensing system for a dishwasher, particularly for residential use, wherein the dishwasher comprises a housing, a wash chamber enclosed by the housing, and a door for accessing the wash chamber. The dispensing system comprises a fluid reservoir adapted to be disposed in the door for containing fluid (preferably liquid dishwashing detergent) which may be used to treat dishes in the wash chamber during a dish cleaning cycle. The system further comprises a pump which is adapted to be disposed in the door, in proximity to the reservoir, for dispensing a predetermined quantity of the fluid from the reservoir into the dishwasher wash chamber one or more times during the dish cleaning cycle. The pump preferably comprises a reciprocating plunger pump, and is solenoid-actuated.

The reservoir has a fluid capacity sufficient for a plurality of dish cleaning cycles without the need for replenishment. In preferred embodiments, the reservoir fluid capacity is approximately equal to the capacity of a typically sized single container of fluid (typically dishwashing detergent) available at retail, so that the consumer may empty the entire contents of the container (bottle) into the reservoir at one time, and then dispose of the container.

In addition to dishwashing detergent, the fluid contained in the reservoir may comprise a dishwasher rinse aid. In one embodiment of the invention, two reservoirs are provided, one of which contains dishwashing detergent, and the other of which contains dishwasher rinse aid.

The above described predetermined quantity (metered dosage) of fluid is preferably adjustable responsive to either controller or user input. Controller input might include, for example, feedback from dish soil sensors which cause the controller to adjust detergent levels to address the sensed soil concentrations. User input might include, for example, depressing a particular dish cycle selector button on the dishwasher, such as "normal cycle" or "pots and pans cycle".

In particular, the dishwasher door described above comprises an interior panel having a recess sized to accommodate the reservoir. The reservoir is thus adapted to be disposed in the recess, in flush-mounted fashion. The reservoir is preferably adapted to be snap-fit into the recess and to be retained therein because of an interference fit. It is adapted to be removed from the recess and re-installed in the recess without using tools, for easy clean-up or re-filling, if desired. It should be noted, however, that the reservoir may also be readily re-filled while installed in the door panel. The reservoir includes an inlet, and may be filled and re-filled with fluid through the inlet. In one alternative embodiment, the reservoir is pre-filled with fluid, and disposable once empty, and is not re-fellable with additional fluid. The reservoir is preferably translucent, so that a level of fluid remaining in the reservoir may be readily determined by a user.

The pump may also be removed and installed without using any tools.

In another aspect of the invention, there is provided a dishwasher for residential use, which comprises a housing and a wash chamber enclosed by the housing. A door is provided in the housing for accessing the wash chamber. A fluid reservoir is disposed in the door for containing fluid (preferably liquid dishwashing detergent) which may be used to treat dishes in the wash chamber during a dish cleaning cycle. A pump is also disposed in the door, in proximity to the reservoir, for dispensing a predetermined quantity of the fluid from the reservoir into the wash chamber one or more times during the dish cleaning cycle. The pump preferably comprises a reciprocating plunger pump, and is solenoid-actuated.

In yet another aspect of the invention, there is provided a method for washing dishes in a residential dishwasher during a dish cleaning cycle, which comprises a step of actuating the dish cleaning cycle, and a further step of actuating a dispenser pump in a door of the dishwasher, for dispensing a metered dosage of dish detergent from a reservoir in said door into a wash chamber in the dishwasher. A further step comprises actuating the dispenser pump a second time during the dish cleaning cycle to dispense a further metered dosage of dish detergent from the reservoir into the wash chamber. In one example of such an operational mode, the first step may occur during a pre-wash cycle, and the second step may occur during a main wash cycle. The dispenser pump actuation step is preferably performed using a solenoid actuator. When the dispenser pump is actuated, a plunger in the pump reciprocates in one direction to draw a metered dose of detergent into a pumping chamber, after which the plunger reciprocates in an opposing direction to dispense the detergent in the pumping chamber into the wash chamber.

In a further aspect of this method, an additional step comprises removing the reservoir from the door, cleaning the reservoir, and replacing the reservoir back into the door, without the use of any tools.

The invention, together with additional features and advantages thereof, may be best understood by reference to the following description taken in conjunction with the accompanying illustrative drawings. In these accompanying drawings, like reference numerals designate like parts throughout the figures.

DESCRIPTION OF THE PREFERRED EMBODIMENTS

Figure 1:
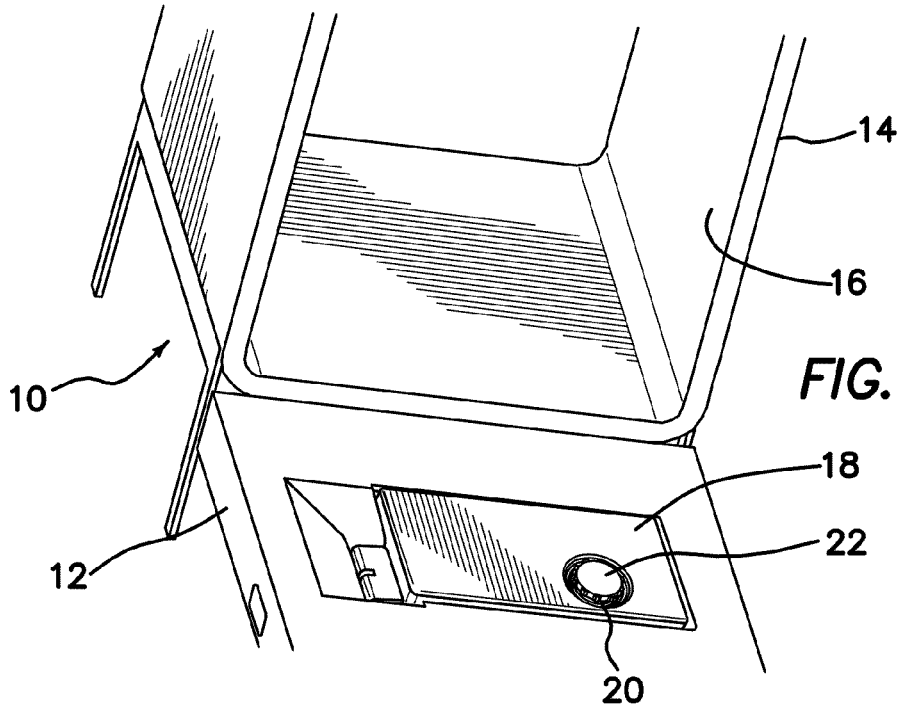
FIG. 1 is a perspective view of a residential dishwasher which is equipped with a bulk detergent dispenser feature in accordance with the present invention.

Referring now to the drawings, there is shown a residential dishwasher 10 having a hinged door 12 and a main housing 14. The dishwasher 10 provides a method for storage and injection of chemicals into the washing chamber 16 thereof. The device is designed to store one complete container of the most common-sized chemical found in the market. The device can inject a plurality of chemicals (detergents and rinse aids are the most common), which are supplied in a liquid state.

A detergent reservoir 18 is flush-mounted inside the door 12 of the dishwasher 10, and is filled via a fill spout 20. A wide, easy-fill quarter-turn lid 22 is recessed within the fill spout 20 to prevent over-fill of the reservoir. Presently, the preferred embodiment includes a reservoir 18 which is supplied with the dishwasher and is reusable for the lifespan of the dishwasher, but in an alternative embodiment, a ready-to-use disposable cartridge, formed by inexpensive blow-molding techniques to fit the provided recess in the door, is pre-filled with detergent and sold to the consumer for installation directly into the door reservoir recess. In this embodiment, a simple cap, rather than the illustrated wide lid, is provided, since there is no necessity for the consumer to fill the reservoir, and thus no chance of spillage. The reservoir further includes a hydrophobic vent (not shown) to ensure that the detergent reservoir 18 does not collapse when dispensing product. The vent is preferably a labyrinth-seal type vent to allow air movement in both directions, but excludes water from entering the reservoir or detergent from weeping out. Air enters the reservoir when the detergent is dispensed, through the vent, in order to prevent the reservoir from collapsing. As the temperature rises during the operating cycle of the appliance, expanding air inside the reservoir exits through the vent.

Advantageously, the reservoir 18 may be transparent or translucent to permit an operator to readily determine the detergent level in the reservoir. Alternatively, other known gauging systems may be employed.

Figure 2:
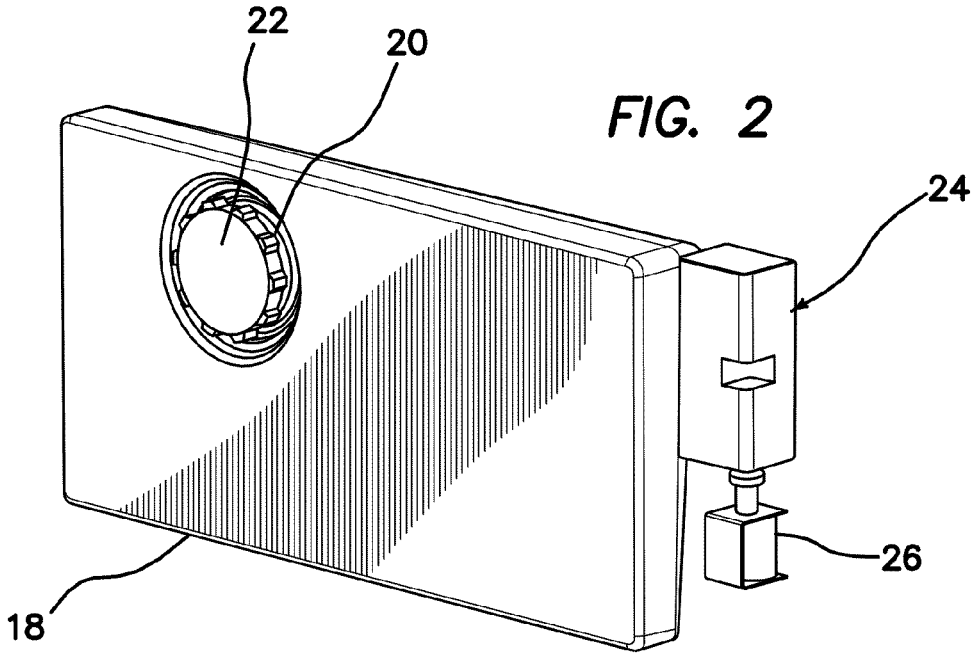
FIG. 2 is a perspective view of the bulk detergent dispenser of FIG. 1, shown in isolation.

The inventive dish detergent dispenser comprises four components. In addition to the reservoir 18, the dispenser comprises a dispenser pump 24 (FIG. 2), a solenoid actuator 26, and a circuit board/controller (not shown). All of the components 18, 24, 26 are mounted in the door 12. The circuit board/controller may be mounted anywhere on the dishwasher, including the door, as long as the selected location is sealed from contact with liquids in order to protect the electronics. The controller electronically controls the dispensing function for precision and differentiation.

Figure 3:
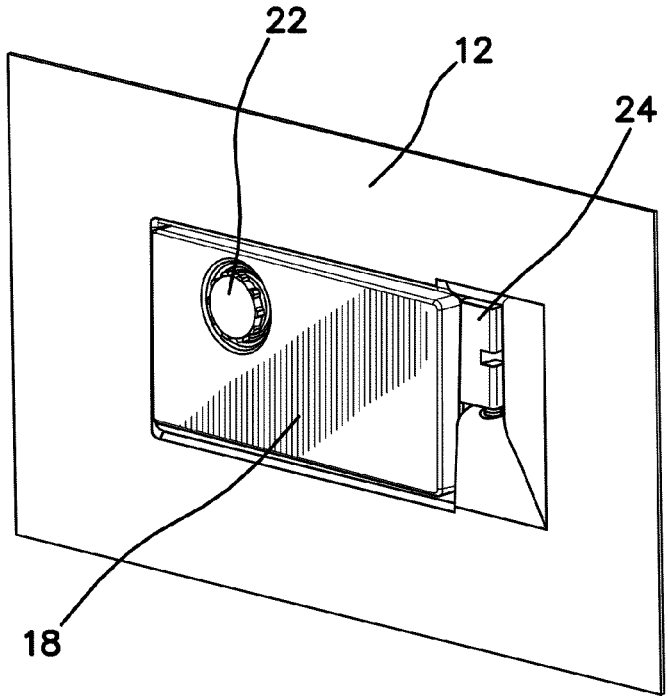
FIG. 3 is a perspective view of the interior of the dishwasher door, showing the bulk detergent dispenser of FIG. 2 installed therein.

As noted above, and referring particularly to FIGS. 2 and 3, both the detergent reservoir 18 and the dispenser pump 24 are semi-flush mounted inside recesses within the door 12, as illustrated in FIG. 3. Both components snap in easily to the inside face of the door, with an interference fit, as shown. The reservoir's interference fit with respect to the recess is a rather loose one, owing to the relatively thin-walled construction of the reservoir. On the other hand, the interference fit of the pump in its respective recess is rather tight, owing to the relatively thick-walled construction of the pump body.

The solenoid actuator 26 is mounted behind the door panel, which may be fabricated of stainless steel or other suitable materials, for safety and protection. The reservoir 18 is preferably designed to hold the contents of one "grocery store" bottle. Since the fill location 22 of the reservoir 18 is inside the dishwasher, spill clean up is easy. The semi-flush mounting design makes the reservoir sufficiently low profile so that it does not interfere with the lower rack as it slides in and out, nor does it substantially reduce usable tub volume (volume of the washing chamber 16).

Figure 4:
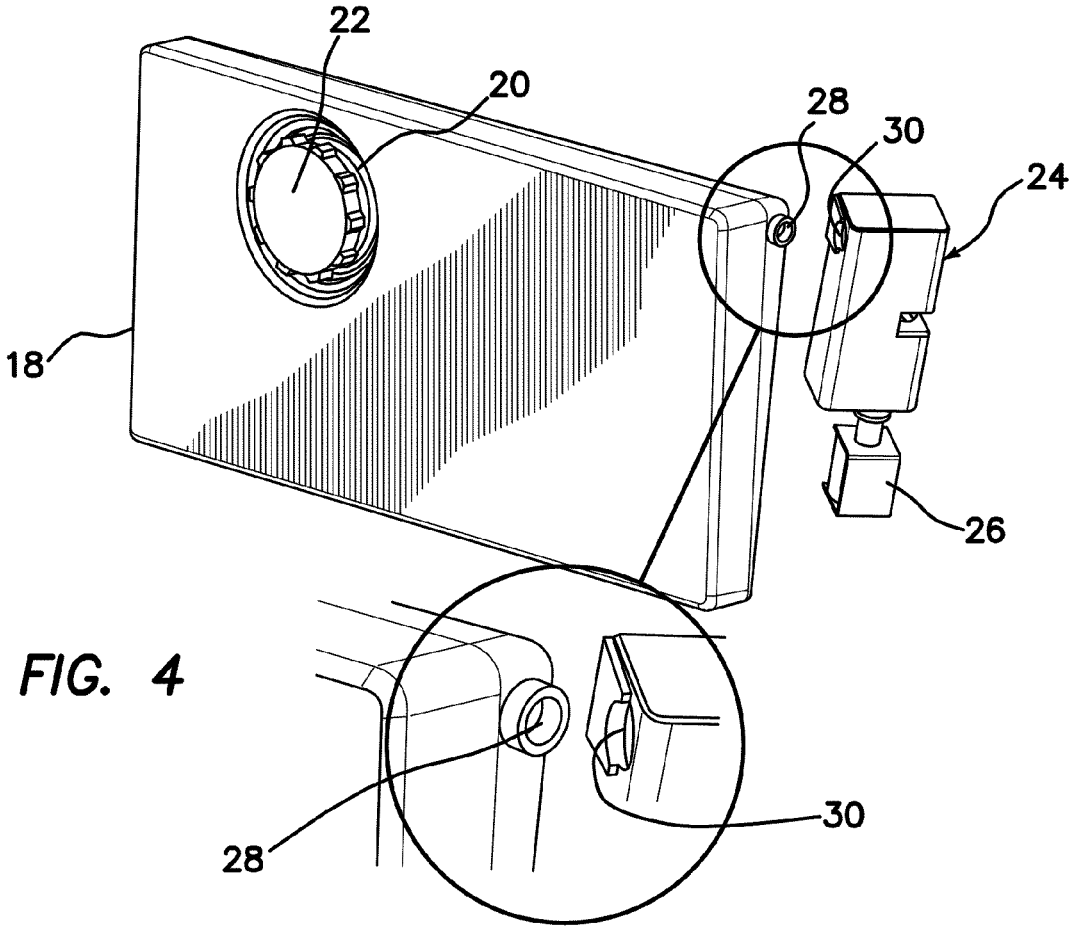
FIG. 4 is a perspective view illustrating the fluid connection between the dispenser reservoir and liquid pump shown in FIG. 2.

As shown in FIG. 4, engaging seals 28, 30 on the reservoir 18 and the pump 24, respectively, allow the reservoir and pump to be easily snapped together with a tight seal. The same interface design is provided for the alternative embodiment (not shown), employing a pre-filled recess-fitting detergent cartridge.

Figure 5:
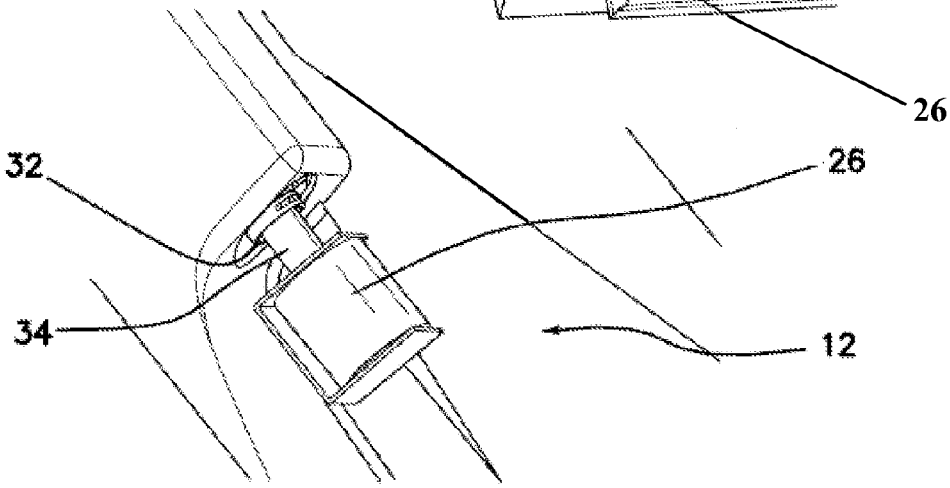
FIG. 5 is a perspective view illustrating the solenoid installation.
Figure 5A:
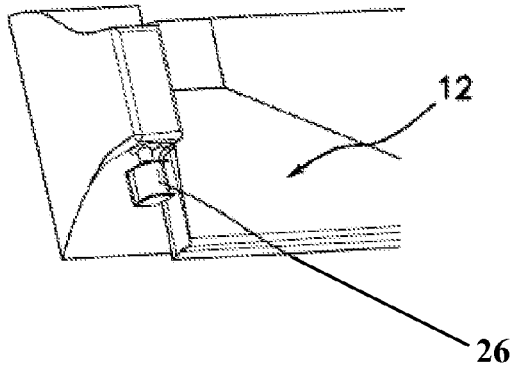
FIG. 5A is an enlarged view of a portion of FIG. 5, showing the solenoid installation more clearly.

FIGS. 5 and 5A illustrate, in tiled figures, the rear side of the inner door panel 12, so that the solenoid can be seen behind the panel, on the "dry" side of the panel. As can be seen, only one access hole 32 is provided in the panel 12, for accommodating the connector 34 between the solenoid 26 and the pump 24. Preferably, a soft elastomeric accordion seal (not shown) is employed to seal this hole 32, which provides a low stress seal even with lots of axial movement. Such a static seal ensures lifetime leak-free performance.

Figure 6A:
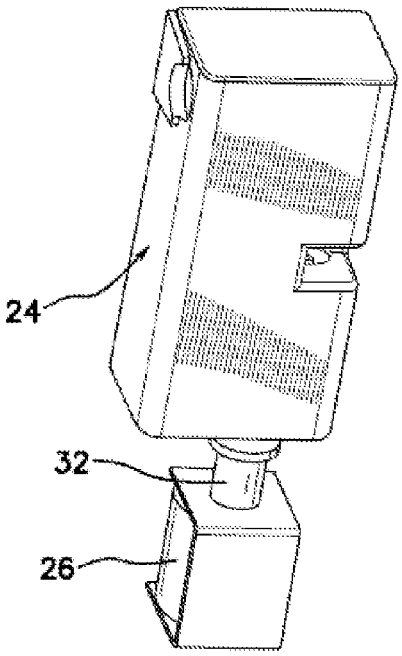
FIG. 6A is a perspective view of the liquid detergent pump of the present invention.
Figure 6B:
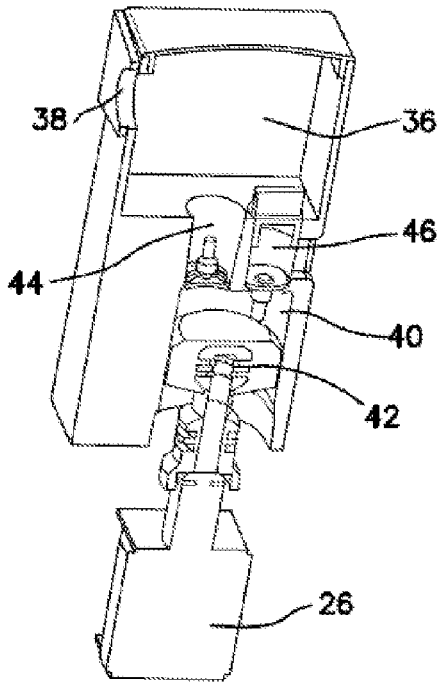
FIG. 6B is a perspective view of the liquid detergent pump of FIG. 6A, shown in cross-section in order to illustrate the internal mechanisms of the pump.

As shown in FIGS. 6A and 6B, the preferred detergent pump 24 has few parts. The one moving part is actually part of the solenoid actuator 26. As noted previously, the pump 24 is wetted in the dishwasher, while the solenoid 26 is isolated on the dry side of the panel. The pump is a simple plunger pump, comprising a detergent batch chamber 36 having an inlet port 38, a pumping chamber 40, defined by a reciprocating plunger 42, a pumping chamber inlet port 44, and a pumping chamber outlet port 46. The plunger 42 is driven by the solenoid actuator 26 and preferably includes wiper seals for sealing the pumping chamber 40. Any weeping past the wiper seals goes into the wash chamber 16, where the detergent is destined to go anyway. The plunger is spring-loaded, and is normally extended all the way into the pumping chamber. Energizing the solenoid 26 causes the plunger to retract, drawing liquid from the batch chamber 36 to the pumping chamber 40 through the pumping chamber inlet port 44. De-energizing the solenoid actuator 26 causes the spring to relax, extending the plunger 42 and thus dispensing detergent from the pumping chamber 40 through the pumping chamber outlet port 46. Advantageously, large passages and short flow paths are employed to permit free movement of thick gel detergent.

Figure 7A:
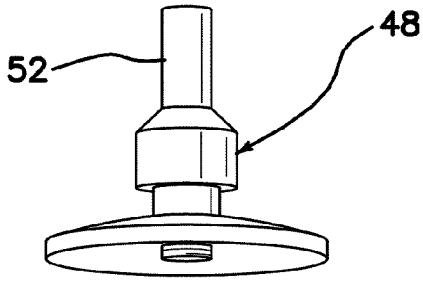
FIG. 7A is a perspective view of an umbrella check valve which may be employed in the present invention.
Figure 7B:
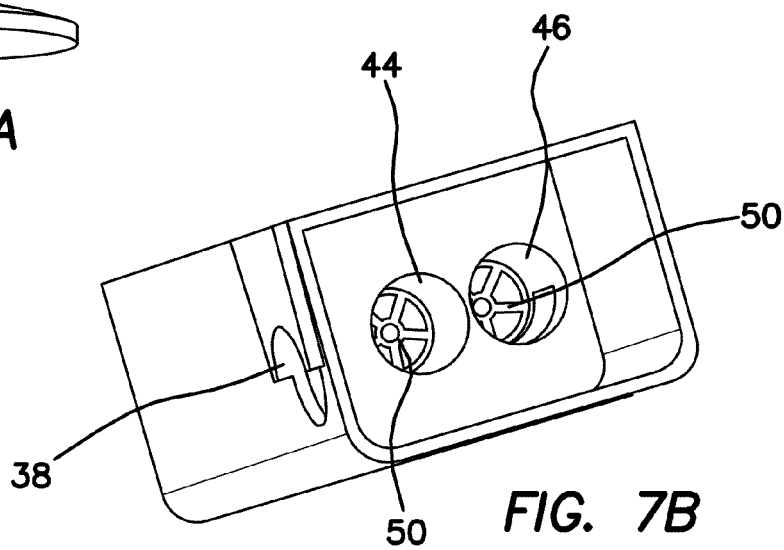
FIG. 7B is a perspective view of check valve seats which may be employed in the present invention.
Figure 7C:
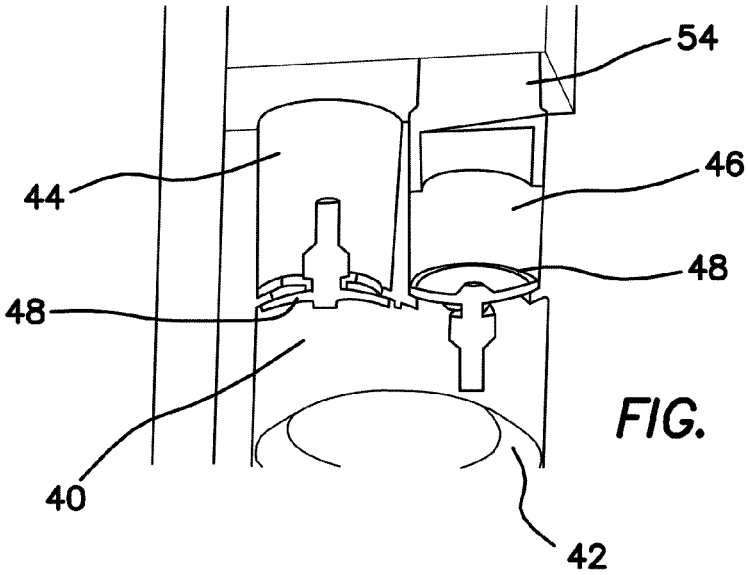
FIG. 7C is a schematic view illustrating the function of the check valves employed in the present invention

Now with reference particularly to FIGS. 7A, 7B, and 7C, an umbrella check valve 48 is preferably employed in each of the pumping chamber inlet and outlet ports 44, 46, respectively. Valve seats 50 for each of the said inlet and outlet ports are shown in FIG. 7B. Umbrella check valves are preferred because they comprise soft elastomers that move easily and have low stress. As shown in FIG. 7A, an extended piece 52 is employed to pull the valve through the mounting hole. This piece 52 is designed to break off after pull-through, during assembly. The valve seats 50 utilize large passages in order to maintain low liquid resistance. A plug 54 (FIG. 7C) is disposed in the discharge passage in order to finish the pump.

Figure 8:
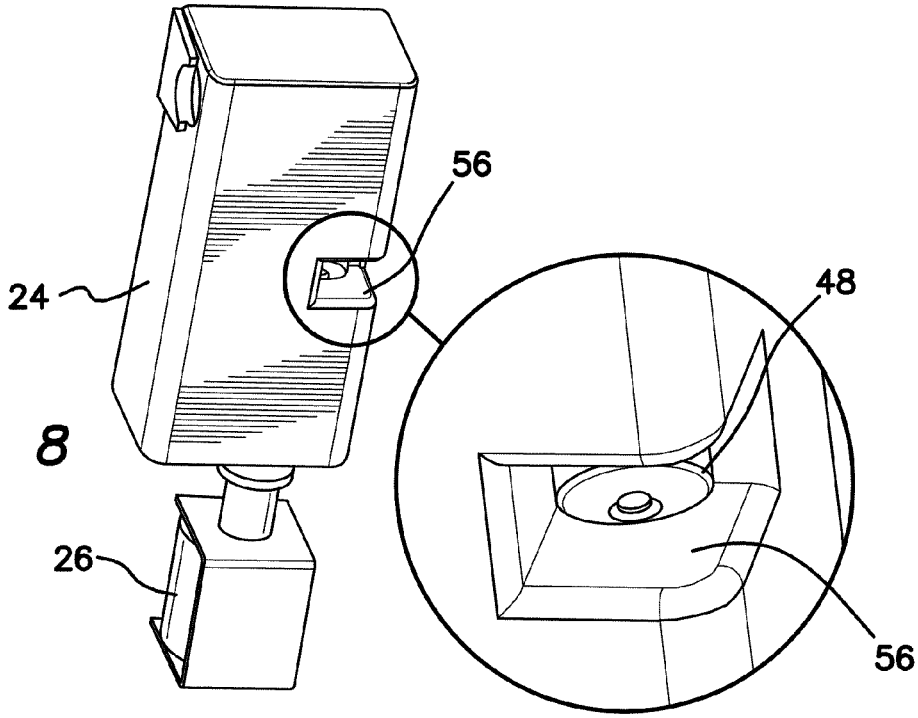
FIG. 8 is a perspective view illustrating the detergent pump discharge structure.
Figure 9:
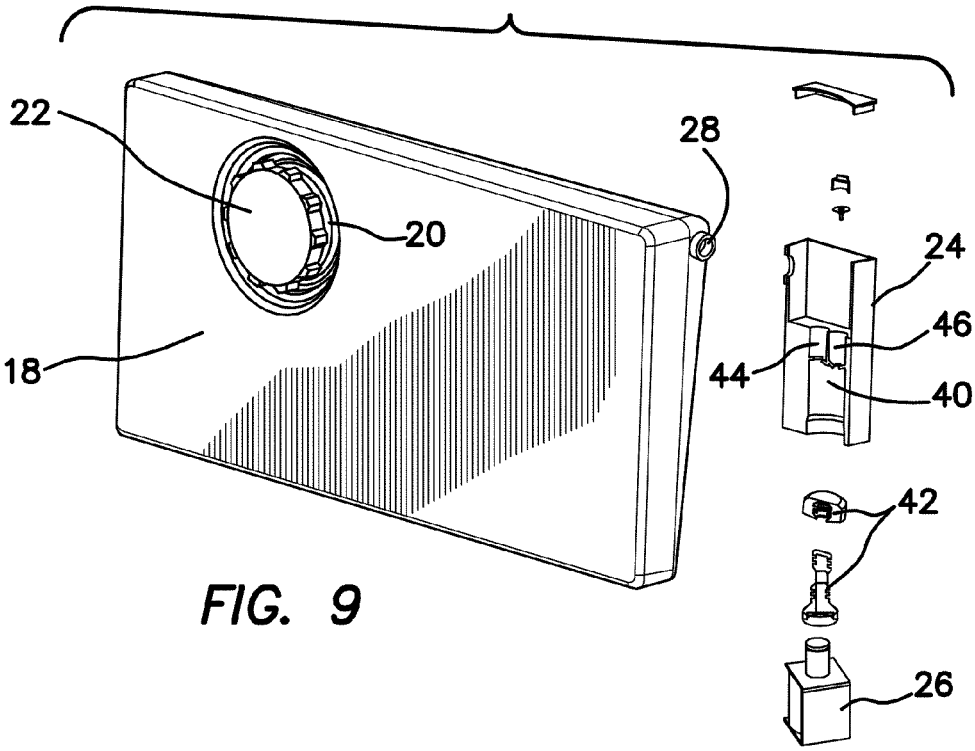
FIG. 9 is a perspective view of the dish detergent dispenser of FIGS. 1-8, illustrated in an exploded view the construction of the detergent pump.

FIGS. 8 and 9 illustrate additional details of the inventive dispensing system.

In operation, when the dishwasher door 12 is opened, the pump batch chamber 36 is filled. When the door is closed, excess detergent runs out of the batch chamber, leaving a full batch of predetermined volume of detergent behind. The "full batch" of detergent typically includes a smaller volume for a pre-wash cycle and a larger volume for a main wash cycle. In one particular embodiment, for example, a full batch is approximately 60 ml, including 20 ml for a pre-wash cycle and 40 ml for a main wash cycle, but these values may vary, depending upon application and specifications of the particular dishwasher in which the dispenser is disposed. Also, when the door is closed, the detergent level in the main reservoir drops below the batch chamber fill port to prevent re-filling.

This main reservoir/batch chamber design effectively isolates the main reservoir from water contamination. Water would need to flow against two check valves, then up and over the spillway to gain access to the main chamber.

Each stroke of the solenoid pushes a small amount of detergent into the dishwasher wash chamber, through a discharge passage 56. A full pre-wash dose typically requires a few strokes. A full dose of main wash requires more strokes. For example, in one particular embodiment, each stroke of the solenoid dispenses approximately 4 ml of detergent into the wash chamber. In this embodiment, five strokes of the solenoid supplies sufficient detergent for a pre-wash cycle and ten strokes of the solenoid supplies sufficient detergent for a main wash cycle. Of course, these particular values are exemplary only, and subject to dishwasher specifications, soil load, and the like.

The batch chamber 36 need not be emptied on every wash cycle. It is all right to utilize less detergent for a particular load and to leave the chamber partially filled. It should be noted that the detergent pump discharge passage 56 is preferably wide and short, for two primary reasons. One reason is to ensure that there is absolutely minimal liquid resistance for the pump to overcome. The second reason is so that spray water from the washing chamber 16 splashes the passage 56 clean, but cannot get past the pump outlet passage umbrella valve 48.

Figure 10:
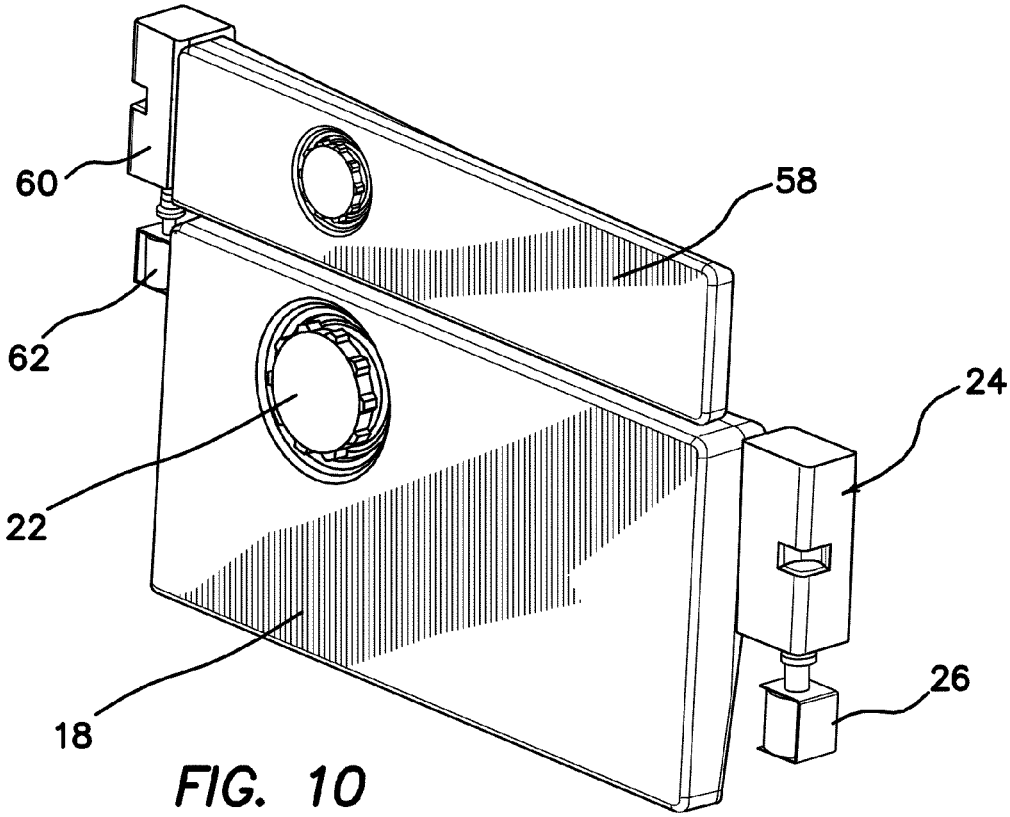
FIG. 10 is a perspective view similar to FIG. 2, illustrating a modified embodiment of the dispenser of the present invention which comprises both a detergent and a rinse aid dispenser.
Figure 11:
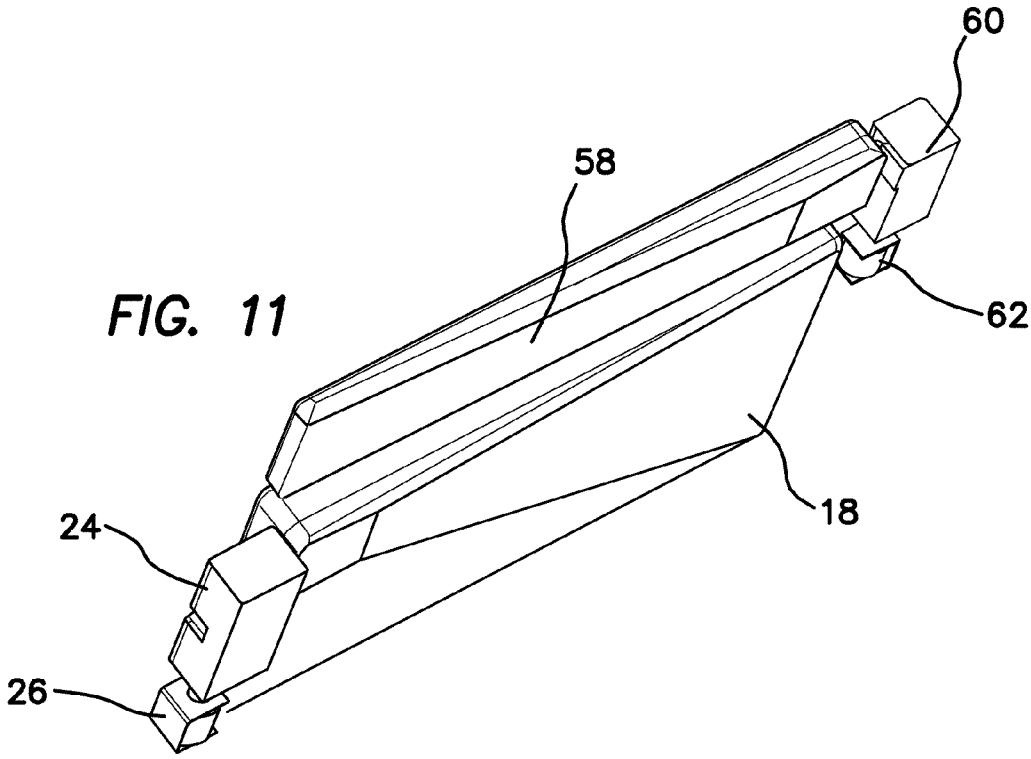
FIG. 11 is a perspective view, from the rear, showing the embodiment of FIG. 10.

In FIGS. 10 and 11, there is shown a modified embodiment of the detergent reservoir 18, which includes a second reservoir 58, for dispensing a rinse aid or the like. A second dispenser pump 60 and solenoid actuator 62 may be utilized to dispense the rinse aid. As presently embodied, the rinse aid dispensing system essentially duplicates the detergent dispensing system described above.

Three versions of the inventive detergent dispensing system are currently contemplated. A first, basic version dispenses a fixed amount (40 ml in one exemplary embodiment) of detergent automatically when called upon by the dishwasher. This version may or may not allow prewash dosing. A second, more sophisticated version dispenses a variable amount of detergent, the adjustment being enabled using an electrical dial on the control panel of the dishwasher, often located on the door. The volume ranges from "minimum" to "normal", to "heavy load". A third, even more sophisticated version dispenses a variable amount of detergent driven from a soil load sensing technology, which is a sensor system having a capability of detecting the level of soil present on the dishes being washed. In this version, the consumer also has the option of overriding with a manual volume dial.

Figure 12:
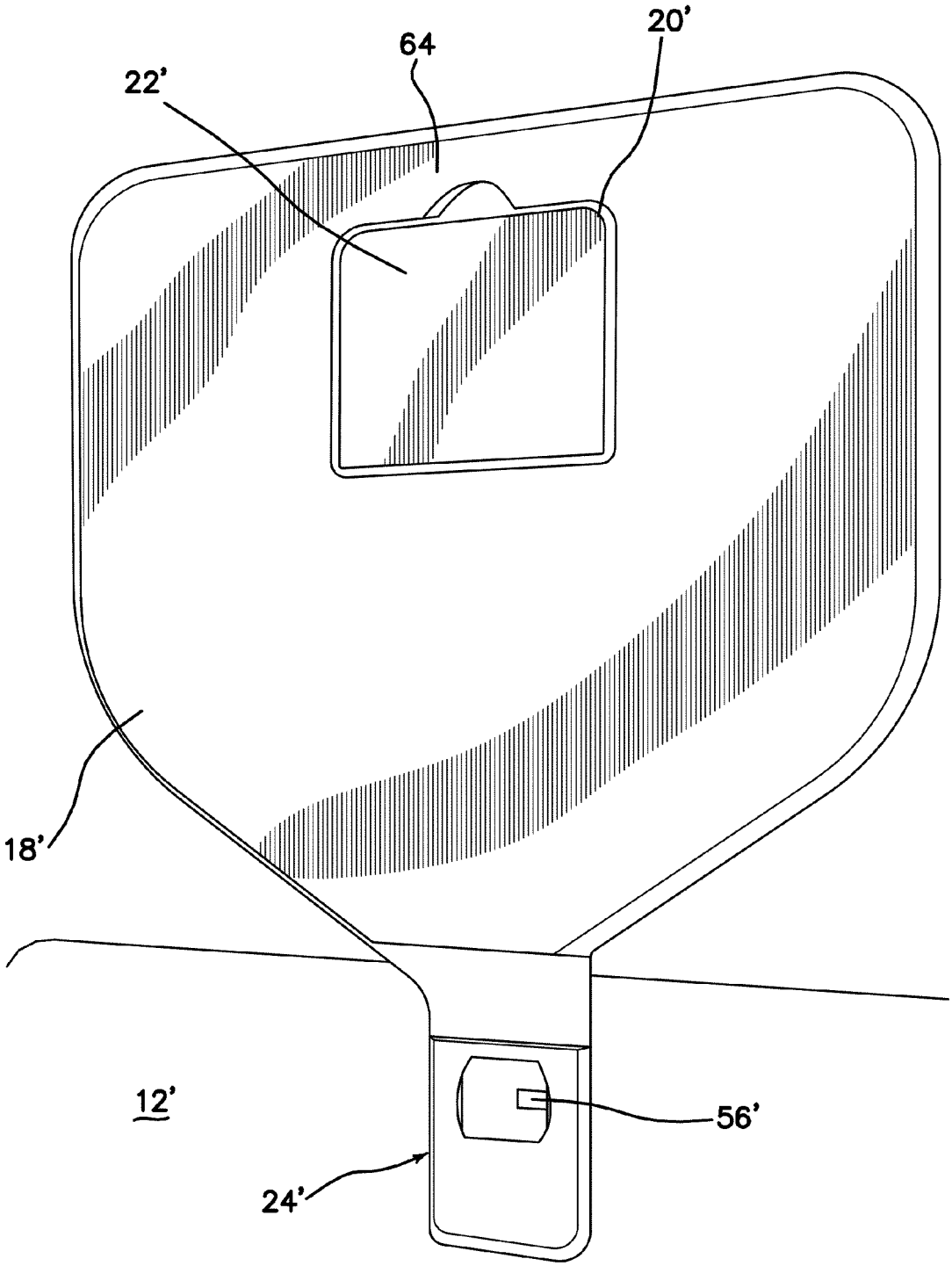
FIG. 12 is a plan view of a modified embodiment of the present invention, showing the installation of a detergent reservoir in the door of a dishwasher.

Now with reference to FIG. 12, a modified embodiment of the reservoir and pump of the present invention is illustrated. In this embodiment, a detergent reservoir 18' is flush-mounted in an inside panel of a dishwasher door 12'. The reservoir 18' has a lid 22' for closing a fill spout 20'. The lid 22' is of the "flip-top" type, and may be flipped between the illustrated closed position, and an open position for filling the reservoir 18'. A fingertip recess 64 is provided for enabling a user's fingertip to engage and open the lid 22'. A dispenser pump 24'is provided directly beneath the reservoir 18', as shown, having a fluid discharge passage 56'. The pump 24' is constructed in a similar manner to that discussed above with respect to pump 24. An advantage of this embodiment is to improve flow of fluid from the reservoir into the pump, because of the immediate proximity of the reservoir outlet to the pump inlet.

Figure 13:
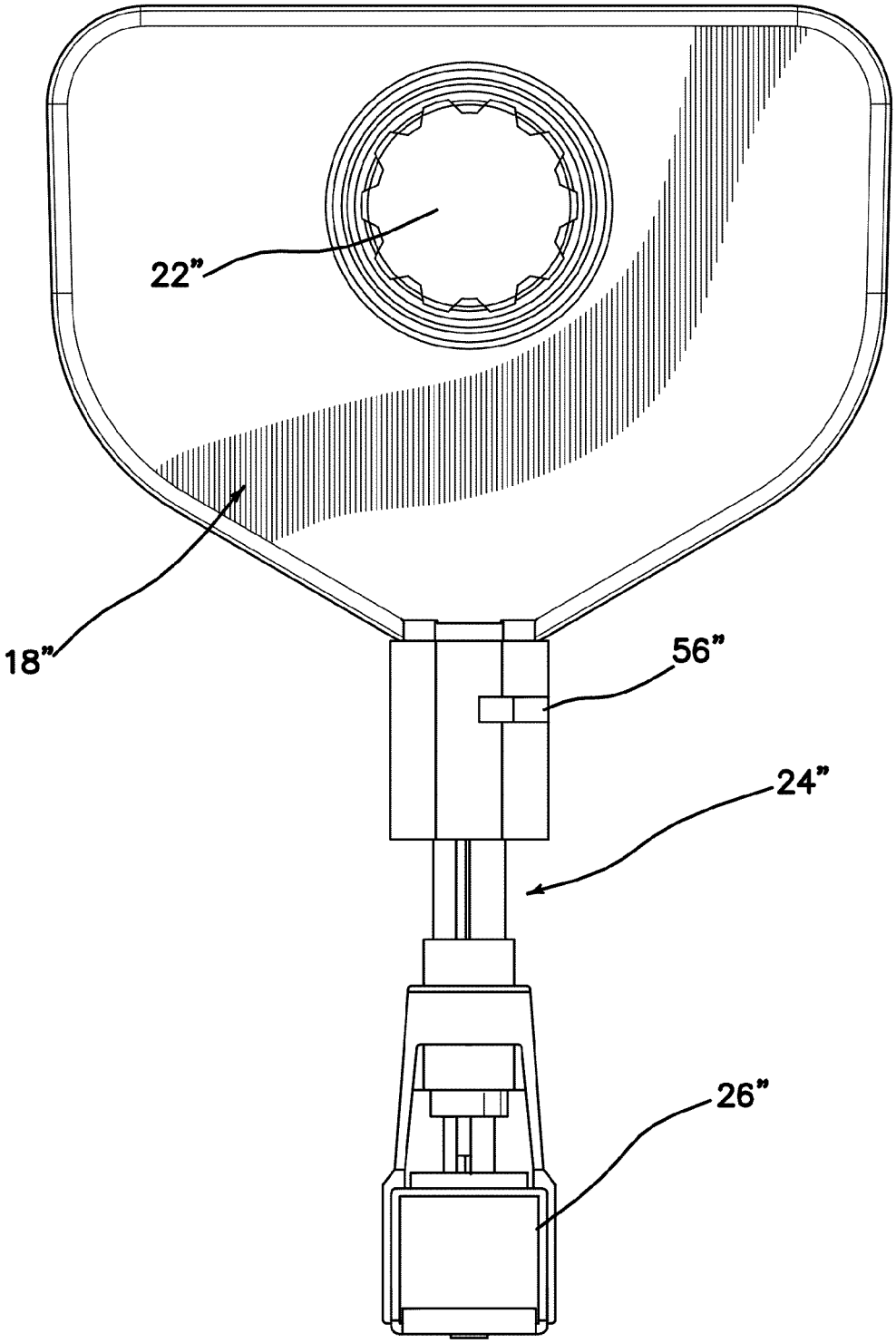
FIG. 13 is a schematic view of a further modified embodiment of the present invention.

In FIG. 13 there is shown yet another modified embodiment of the invention, including a reservoir 18" having a lid 22" similar to the lid 22 of the first illustrated embodiment. Again, at the base of the reservoir 18", which is adapted for disposition in a dishwasher door, as in prior embodiments, is a dispenser pump 24". The dispenser pump 24" comprises a solenoid actuator 26" and a discharge passage 56". In this embodiment, as in the FIG. 12 embodiment, fluid flow from the reservoir into the pump is facilitated by the immediately proximity of the pump inlet beneath the reservoir outlet.

While this invention has been described with respect to various specific examples and embodiments, it is to be understood that various modifications may be made without departing from the scope thereof. Therefore, the above description should not be construed as limiting the invention, but merely as an exemplification of one preferred embodiment thereof.

What is claimed is:

1. A dishwasher for residential use, comprising:

a housing;

a wash chamber enclosed by said housing;

a door for accessing said wash chamber;

a fluid reservoir disposed in said door for containing fluid which may be used to treat dishes in said wash chamber during a dish cleaning cycle; and a pump disposed in said door for dispensing a predetermined quantity of said fluid from said reservoir into said wash chamber one or more times during said dish cleaning cycle;

said pump comprising:

a batch chamber having an inlet port;

a pumping chamber defined by a reciprocating plunger and having a pumping chamber inlet port;

a pumping chamber outlet port;

a first check valve in said batch chamber inlet port; and a second check valve in said pumping chamber inlet port;

wherein during operation of the dishwasher said fluid flows from said fluid reservoir through said batch chamber inlet port into said batch chamber, then through the pumping chamber inlet port into the pumping chamber, then through the pumping chamber outlet port into the wash chamber, said first and second check valves functioning to prevent water migration from the wash chamber into the fluid chamber.

2. The dispensing system as recited in claim 1, wherein said reservoir further comprises a fluid outlet and a cap for closing said fluid outlet.

3. The dishwasher as recited in claim 1, wherein said reservoir includes an inlet, and may be filled and re-filled with fluid through said inlet.

4. The dishwasher as recited in claim 1, wherein said reservoir is pre-filled and disposable once empty, and is not re-Tillable with additional fluid.

5. The dishwasher as recited in claim 1, wherein said reservoir is translucent, so that a level of fluid remaining in said reservoir may be readily determined by a user.

6. The dishwasher as recited in claim 1, wherein said pump may be removed and installed without using any tools.

* * * * *

UNITED STATES PATENT AND TRADEMARK OFFICE

CERTIFICATE OF CORRECTION

PATENT NO. : 7,931,032 B1
APPLICATION NO. : 12/619984
DATED : April 26, 2011
INVENTOR(S) : Daniel J. Penkauskas et al.

It is certified that error appears in the above-identified patent and that said Letters Patent is hereby corrected as shown below:

Column 8, lines 16-18 should read:
"4. The dishwasher as recited in claim 1, wherein said reservoir is pre-filled and disposable once empty, and is not re-fillable with additional fluid."

Signed and Sealed this
Ninth Day of August, 2011

David J. Kappos

David J. Kappos
*Director of the United States Patent and Trademark Office*